US005415118A

United States Patent [19]

Adamski, Jr. et al.

[11] Patent Number: 5,415,118

[45] Date of Patent: May 16, 1995

[54] ALIGNMENT DEVICE FOR A SEWING MACHINE

[75] Inventors: Maximilian Adamski, Jr., Palatine; Gary J. Michal, Streamwood; Robert G. Tegel, Huntley, all of Ill.

[73] Assignee: Union Special Corporation, Huntley, Ill.

[21] Appl. No.: 23,866

[22] Filed: Feb. 26, 1993

Related U.S. Application Data

[63] Continuation of Ser. No. 514,827, Apr. 26, 1990, abandoned.

[51] Int. Cl.[6] ..... D05B 19/00; D05B 35/10; D05B 37/04

[52] U.S. Cl. ..... 112/121.11; 112/122; 112/153; 112/306; 226/15

[58] Field of Search ..... 112/153, 306, 308, 303, 112/121.11, 136, 121.12, 309, 122, 126, 129; 250/548, 561; 226/15, 17; 242/57.1

[56] References Cited

U.S. PATENT DOCUMENTS

| | | | |
|---|---|---|---|
| 2,617,374 | 11/1952 | De Robertis | 112/122 |
| 3,417,718 | 12/1968 | Andersson | 112/153 |
| 3,986,467 | 10/1976 | Hornkohl | 112/153 X |
| 4,049,213 | 9/1977 | Hank et al. | 242/57.1 |
| 4,280,422 | 7/1981 | Jung | 112/153 X |
| 4,455,954 | 6/1984 | Franck, III et al. | 112/306 X |
| 4,608,936 | 9/1986 | Ball et al. | 112/153 X |
| 4,825,787 | 5/1989 | Babson et al. | 112/153 X |
| 4,960,234 | 10/1990 | Focke | 226/15 |

FOREIGN PATENT DOCUMENTS

| | | | |
|---|---|---|---|
| 0519947 | 10/1940 | United Kingdom | 112/153 |

*Primary Examiner*—Peter Nerbun

*Attorney, Agent, or Firm*—Morgan & Finnegan

[57] ABSTRACT

A device for aligning a garment for a sewing machine provided with a device for moving the garment towards the sewing machine, and a device for aligning the garment to a lateral window along the moving device to obtain precision in alignment of the garment.

11 Claims, 6 Drawing Sheets

FIG. 4
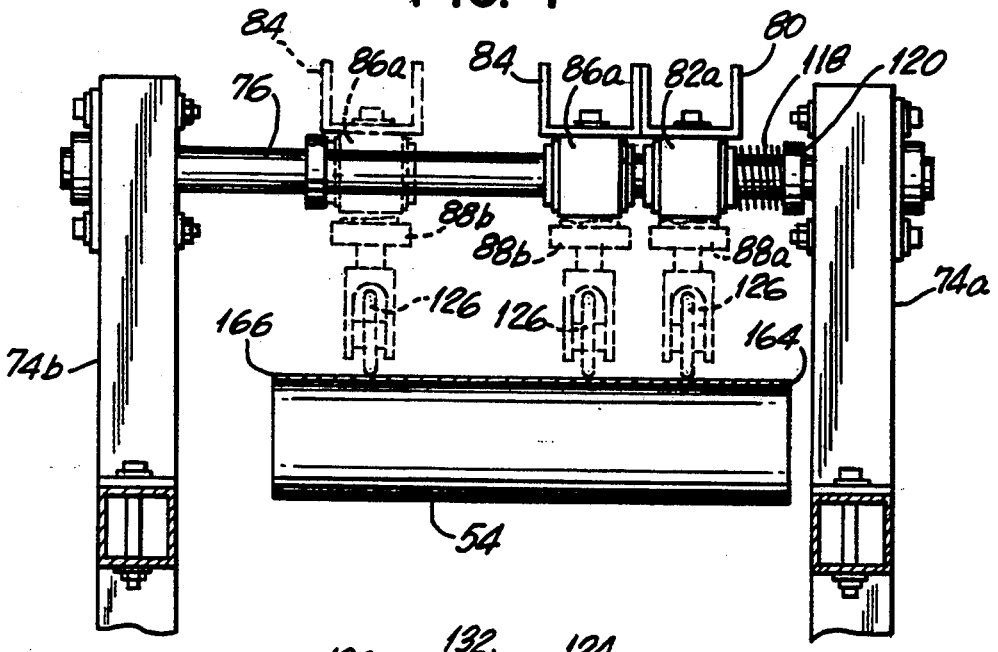
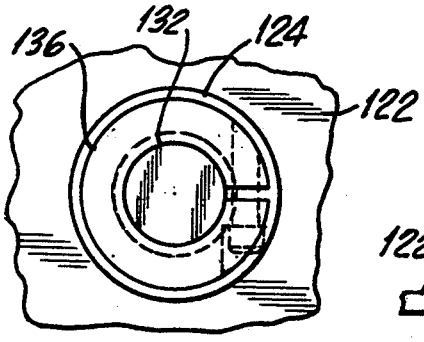
FIG. 9
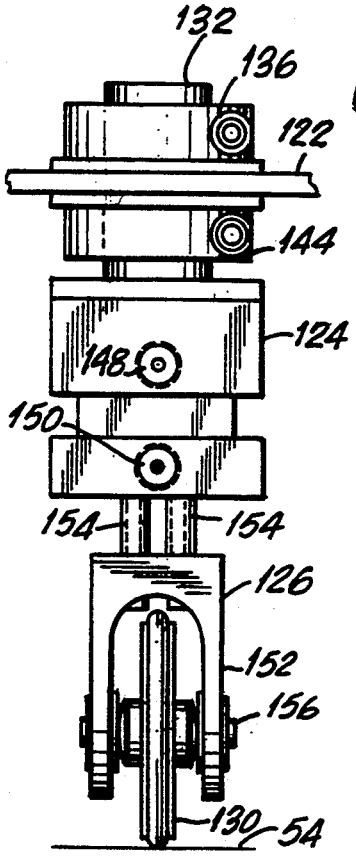
FIG. 8
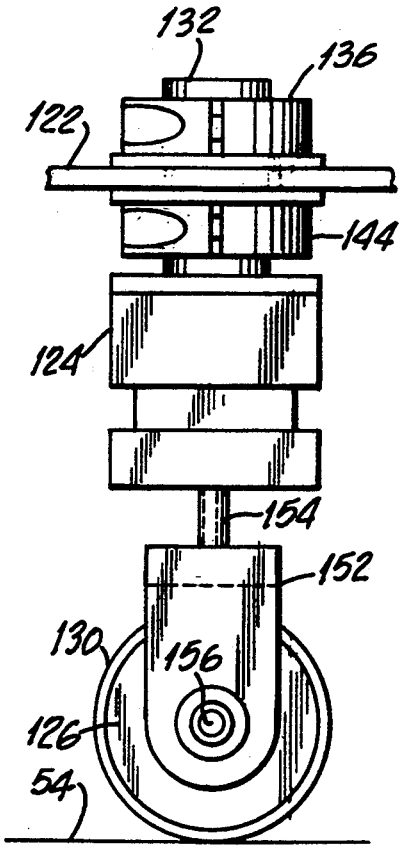
FIG. 10

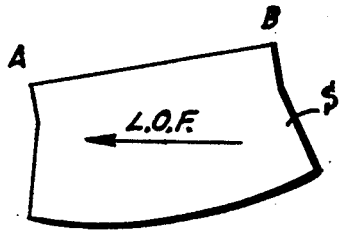
FIG.11a
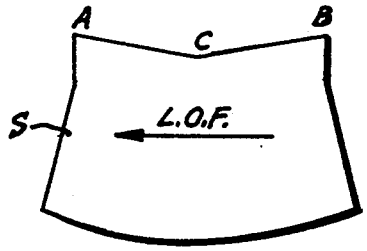
FIG.11c
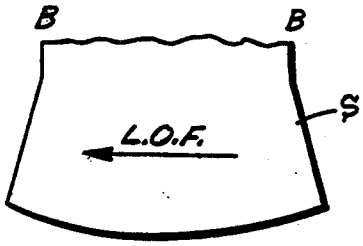
FIG.11e
FIG.11d
FIG.11b
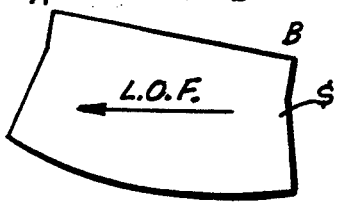
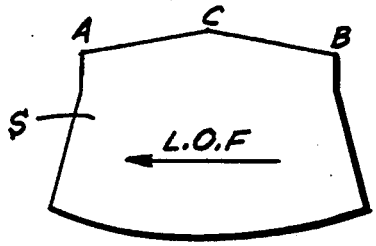
FIG.12
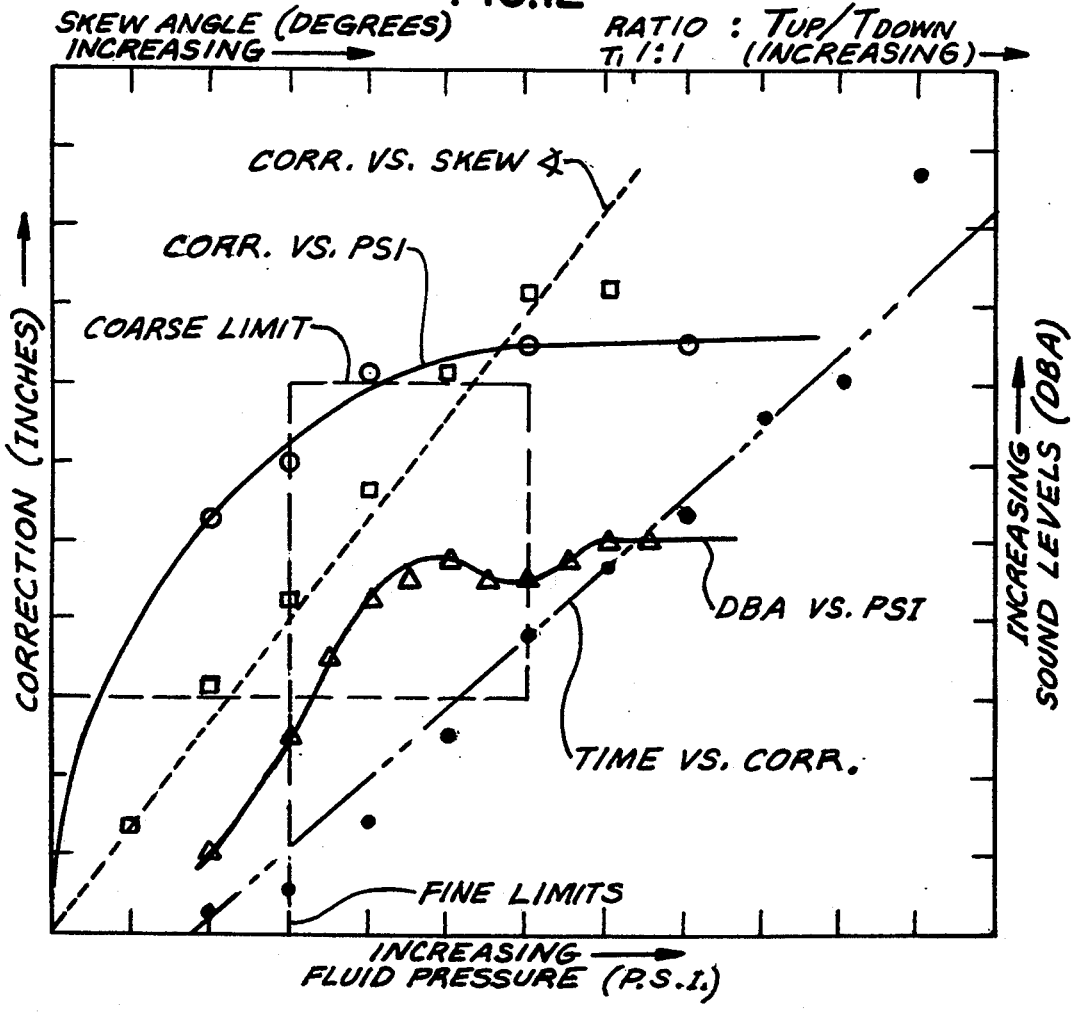

ALIGNMENT DEVICE FOR A SEWING MACHINE

This is a continuation of application Ser. No. 07/514,827, filed on Apr. 26, 1990, now abandoned.

BACKGROUND OF THE INVENTION

The present invention relates to a device for aligning a garment for a sewing machine.

The alignment of garments or sleeves by a device for a sewing machine has been used by machines which attempt to move the garments against a reference edge. However, such machines have not provided a desirable accuracy for alignment of the garments. The sewing heads of the sewing machines normally trim material from the sleeves as they pass through the sewing machines. If the sleeves are not trimmed properly, then the sleeves leave an open space when folded and sewn and the sewing is incomplete resulting in a rejected garment and wasted material. An excessive amount of material is trimmed from the sleeves as they pass through the sewing machines resulting in loss of economical use of the material. It is also desirable to control displacement of the material, control the force and energy levels of operating parts of the machine, and also control the sound levels during operation.

SUMMARY OF THE PRESENT INVENTION

A principle feature of the present invention is the provision of an improved device for aligning a garment for a sewing machine.

The device of the present invention comprises, a first wheel assembly having a rotatable wheel engageable against a moving surface over the garment between the wheel and surface, rotating means for modifying the angle of said wheel relative to the moving direction of the surface at a first skew angle, a second wheel assembly having a rotatable wheel subsequently engageable against the surface over the garment between the wheel and surface, rotating means for modifying the angle of said wheel of the second wheel assembly relative to the moving direction of the surface at a second skew angle less than the first skew angle, a third wheel assembly having a rotatable wheel subsequently engageable against the surface over the garment between the wheel and surface, and rotating means for modifying the angle of said wheel of the third wheel assembly relative to the moving direction of the surface at a third skew angle less than the second skew angle, in which the first, second, and third wheel assemblies are subjected to fluid under pressure in a controlled manner, in which the first, second, and third wheel assemblies have a controlled time constant of a ratio of the time of the wheels against the surface and the time away from the surface, and in which the frequencies of the wheels of the first, second, and third wheel assemblies engaging against the surface are controlled.

Thus, a feature of the invention is that an optimum angle for the wheel assemblies may be provided to obtain the maximum amount of correction.

Another feature of the invention is that the fluid pressures may be controlled to provide the optimum amount of correction.

Yet another feature of the invention is that the time constants may be modified to provide an optimum amount of correction.

A further feature of the invention is that the frequencies may be selected to provide an optimum amount of correction.

A feature of the invention is that later wheel assemblies may be controlled to act differently on the garments than earlier wheel assemblies.

Another feature of the invention is that variables may be associated with the skew angles, time constants, fluid pressures, and frequencies, and may be controlled.

Yet another feature of the invention is that the variables are programmable.

Another feature of the invention is that the fluid pressures are controlled to reduce the sound levels of the wheel assemblies.

Yet another feature of the invention is that dynamic balancing is obtained due to the mass ratios of the wheel assemblies.

Still another feature of the invention is that the height or stroke length of the wheel assemblies is selected to control the energy levels of the assemblies and the force of the assemblies on the belts.

A feature of the present invention is that the wheel assemblies are tuned for an optimum amount of displacement and lower air pressures at higher amounts of correction.

Yet another feature of the invention is that a steeper angle of the wheels is achieved by the assemblies.

Still another feature of the invention is that it is only necessary to contact the sleeve by the wheel assemblies a minimal number of times.

Another feature of the invention is that the wheel assemblies may be adjusted to change their dynamic characteristics.

Still another feature of the invention is that the wheel assemblies increase the expected life of the belts while providing an optimum amount of correction in order to provide improved sewing due to repeatability and a more economical machine, product, and operation.

A feature of the present invention is that the alignment device produces a repeatable amount of trim.

Thus, a feature of the present invention is that the alignment device minimizes the amount of material trimmed from the garments.

Yet another feature of the invention is that the alignment device produces an improved garment when trimmed.

A further feature of the invention is that the trim may be automatically adjusted.

Another feature of the invention is that the trim may be programmed under control.

Still another feature of the invention is that the alignment device provides improved economics of the trimmed material.

Yet another feature of the invention that very fine adjustments may be made to alignment of the machine.

Another feature of the invention is that the adjustments may be made in a simplified manner.

Yet another feature of the invention is that the alignment device provides increased accuracy in alignment of the garments.

A feature of the invention is that a garment is aligned to a lateral window while being moved toward the sewing machine.

Another feature of the invention is that the garments may be placed in a lateral space at least as small as the window preparatory to being moved toward the sewing machine.

Yet another feature of the invention is that the garments may be placed in the space in a rapid and simplified manner in order to enhance alignment speed of the garments.

A further feature of the invention is that the garment is aligned to a lateral first window while being moved toward the sewing machine, a lateral second window smaller than the first window while being moved toward the sewing machine, and a lateral third window smaller than the second window while being moved toward the sewing machine.

Thus, a feature of the invention is that the garment is sequentially aligned to smaller windows in a direction toward the sewing machine.

Another feature of the invention is that the width of the windows may be modified.

Still another feature of the invention is that the lateral location of the window may be modified relative to the sewing machine.

Thus, in this manner, the width of trim by the sewing machine may be precisely controlled by the alignment device.

A further feature of the invention is that the alignment device controls the trim in a manner such that the trim is the same on the leading and trailing edges of the garment.

Yet another feature of the invention is that the desired trim is produced irrespective of the orientation of the garments as they are placed for movement toward the sewing machine.

A feature of the invention is that values may be associated with the garments, and may be utilized to control operation of the device.

Another feature of the invention is that the values may be varied.

Yet another feature of the invention is that the values may be programmed.

Further features will become more full apparent in the following description of the embodiments of this invention and from the appended claims.

DESCRIPTION OF THE DRAWINGS

In the drawings:

FIG. 4 is a fragmentary end elevational view of the alignment device of FIG. 3;

FIG. 8 is an elevational view, taken partly in section, of a wheel assembly for the alignment device of FIG. 3;

FIG. 9 is a top plan view of the wheel assembly of FIG. 8;

FIG. 10 is a side elevational view, taken partly in section, of the wheel assembly of FIG. 8;

FIGS. 11*a*–11*e* are diagrammatic views of various configurations of sleeves for alignment by the alignment device of the present invention;

FIG. 12 is a diagram showing characteristic curves exhibited when the alignment device is used.

DESCRIPTION OF THE PREFERRED EMBODIMENTS

Figure 1:
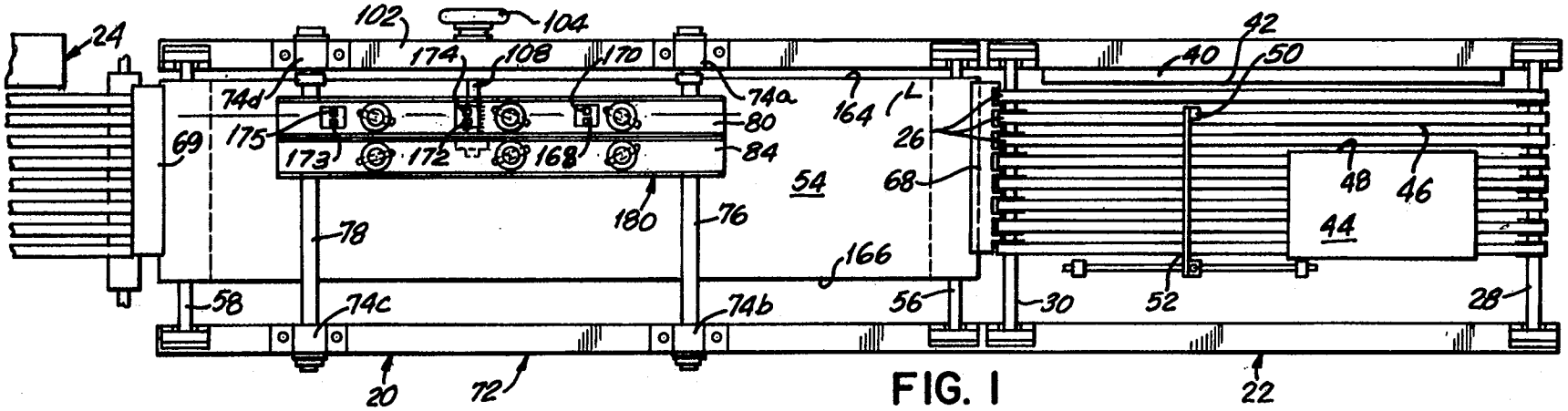
FIG. 1 is a fragmentary plan view of an alignment device of the present invention.
Figure 2:
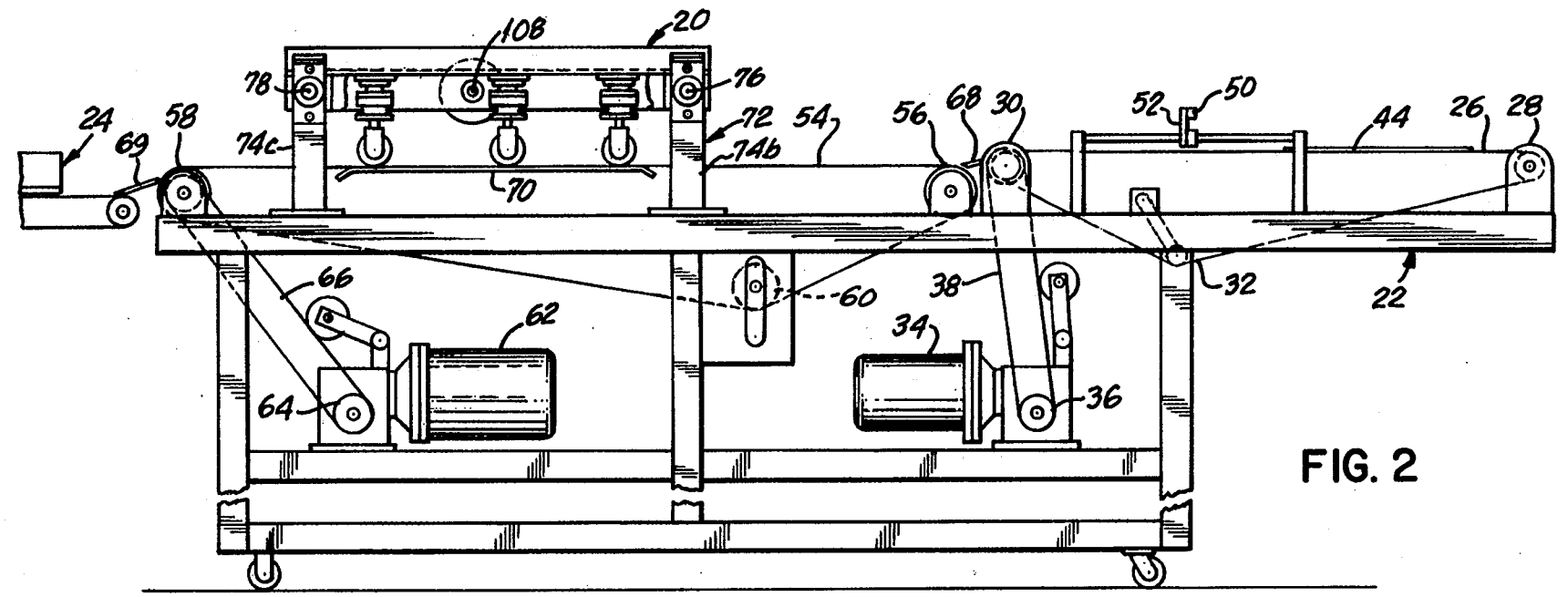
FIG. 2 is a fragmentary elevational view of the alignment device of FIG. 1.

Referring now to FIG. 1–2, there is shown an alignment device generally designated 20 with a loading device generally designated 22 and a sewing machine generally designated 24. The loading device 22 may be of the type disclosed U.S. Ser. No. 07/405,704, filed Sep. 11, 1989, now U.S. Pat. No. 5,190,275 incorporated herein by reference.

The loading device 22 has a plurality of endless belts 26 passing around a plurality of rotatable rollers 28, 30, and 32. The loading device has a motor 34, such as suitable D.C. drive motor, which drives a pulley 36. The loading device 22 has an endless belt 38 passing over the roller 30 and pulley 36, such that the motor 34 drives the belts 26 through the pulley 36, belt 38, and roller 30 in a downstream direction moving sleeves toward the alignment device 20.

The loading device 22 has a longitudinally extending edge member 40 defining a longitudinally extending edge 42 adjacent one side of the belts 26. The loading device 22 has a loading plate 44 located over the belts 26 and defining a space 46 intermediate the edge 42 of the edge member 40 and an outer edge 48 of the loading plate 44. During use of the loading device 22, the sleeves may be placed on the belts 26 in the space 46 intermediate the edges 42 and 48, such that the belts 26 pass the sleeves in a downstream direction toward the alignment device 20.

The loading device 22 has a sensor 50 located by a mounting device 52 at a location over the belts 26 downstream of the loading plate 44, such that the sensor 50 senses the leading and trailing edges of the sleeves passing from the space 46 toward the alignment device 20.

The alignment device 20 has an endless belt 54 passing over a first rotatable roller 56, a second rotatable roller 58, and a third idler roller 60, with the belt 54 extending substantially the width of the alignment device 20. The alignment device has a drive motor 62, such as a suitable A.C. motor, which drives a pulley 64. The alignment device 20 has an endless belt 66 passing over the roller 58 and pulley 64, such that the motor 62 drives the belt 54 through the pulley 64, belt 66, and roller 58 in a direction passing sleeves from the loading device 22 toward the sewing machine 24. The device may have a plate 68 to facilitate passage of the sleeves from the loading device 22 onto the alignment device 20, and a plate 69 to facilitate passage of the sleeves from the loading device 20 toward the sewing machine. The speed of the belt 54 may be faster than the speed of the belts 26 in order to prevent bunching of the sleeves as they pass from the loading device 22 onto the alignment device 20.

Thus, the sleeves may be placed in a simplified manner in the space 46 of the loading device 22 in a configuration with an end margin of the sleeves being located intermediate the edges 42 and 48, and the belts 26 in the space 46 pass the sleeves in a downstream direction toward the alignment device 20. The sleeves may be placed in the space 46 in a rapid and simplified manner without precision of alignment on the loading device 22 in order to enhance the speed of loading. The width of the space 46 may be determined by the distance between the edges 42 and 48.

The sensor 50 senses the leading and trailing edges of the sleeves as they pass from the loading plate 44 toward the alignment device 20, and the speed of the belts 26 relative to the belt 54 may be controlled by the motors 34 and 62 in order to cause modification of the distance between the sleeves as they pass onto the alignment device 20.

Referring now to FIGS. 1–5, the alignment device 20 has an elongated support plate 70 located beneath an upper reach of the belt 54 for use in supporting the belt 54 during operation of the alignment device 20. The alignment device 20 has a frame generally designated 72 having a plurality of upright posts 74*a*, 74*b*, 74*c*, and 74*d*, with the alignment device 20 having a first rod 76 extending between upper ends of the posts 74*a* and 74*b*, and a second rod 78 extending between upper ends of the posts 74*c* and 74*d*, with the rod 78 being aligned with the rod 76.

The alignment device 20 has a first elongated channel 80 having opposed ends secured to linear bearings 82*a* and 82*b* which are slidably mounted on the rods 76 and 78, respectively. The alignment device 20 has a second elongated channel 84 having opposed ends secured to linear bearings 86*a* and 86*b* which are slidably mounted on the rods 76 and 78, respectively, with the channel 84 being located on a side of channel 80. The alignment device 20 has a first pair of alignment members 88*a* and 88*b* mounted on the channels 80 and 84, respectively, a second pair of alignment members 88*c* and 88*d* mounted on the channels 84 and 80, respectively, at a location downstream from the alignment members 88*a* and 88*b*, and a third pair of alignment members 88*e* and 88*f* mounted on the channels 84 and 80, respectively, at a location downstream from the alignment members 88*c* and 88*d*.

With reference to FIGS. 1, 3, 4, and 7, the alignment device 20 may have a pair of spaced air cylinders 90 secured to a pair of inboard brackets 92 which are mounted on a side of the channel 80 on opposed ends of the channel 80 and adjacent the alignment members 88*a* and 88*f*, with the cylinders 90 having an extendible piston 94 with an outer end secured to an outboard bracket 96 which is mounted on the channel 84 on a side opposed the bracket 92. The alignment device 20 has a pair of annular stop members 98 and 100 which may be secured by suitable devices, such as bolts, at a selected lateral position on the rods 76 and 78, respectively. The cylinders 90 may be actuated in order to extend the pistons 94 to a first outer position with the bearings 86*a* and 86*b* engaged against the stop members 98 and 100, respectively, and retract the pistons 94 to a second inner position with the channel 84 located adjacent the channel 80. In this manner, the distance between the alignment members 88*a* and 88*b*, the alignment members 88*c* and 88*d*, and the alignment members 88*e* and 88*f* may be modified through indexing by the cylinders 90, and the modified distance may be selected through use of the stop members 98 and 100.

Figure 3:
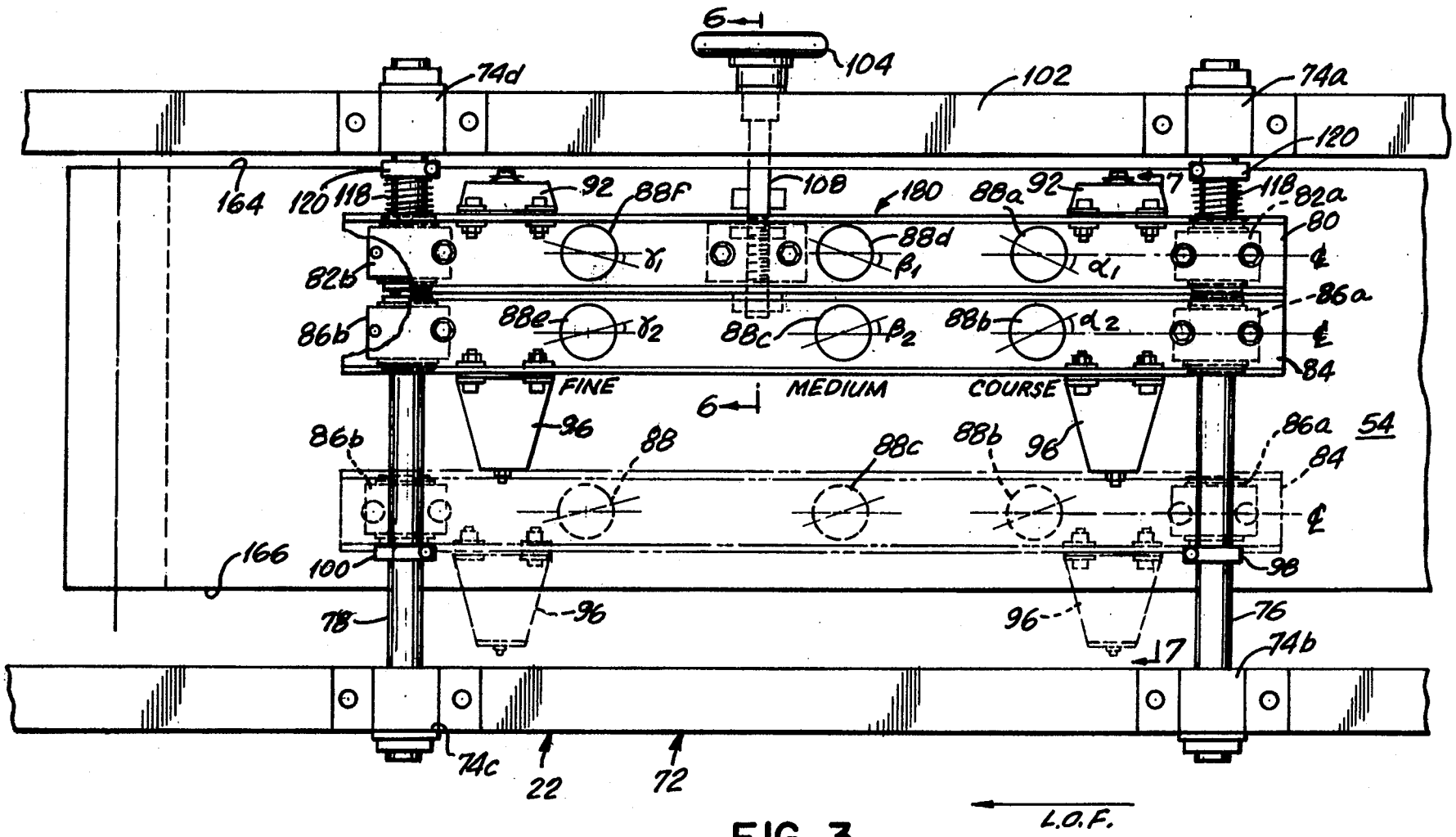
FIG. 3 is a fragmentary top plan view of the alignment device of FIG. 1.
Figure 5:
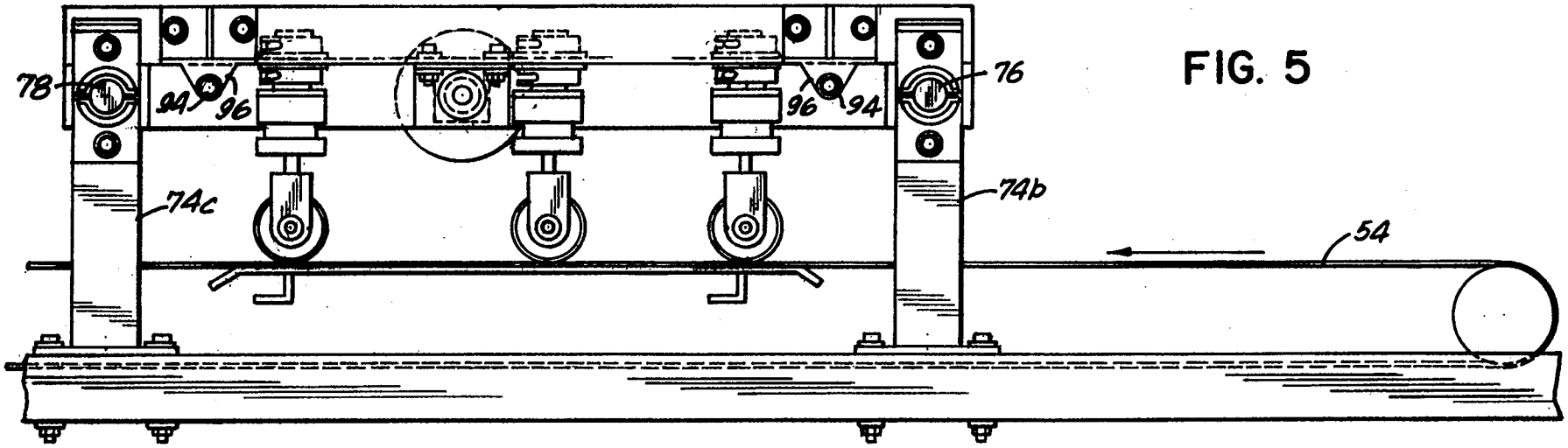
FIG. 5 is a fragmentary side elevational view of the alignment device of FIG. 3.
Figure 7:
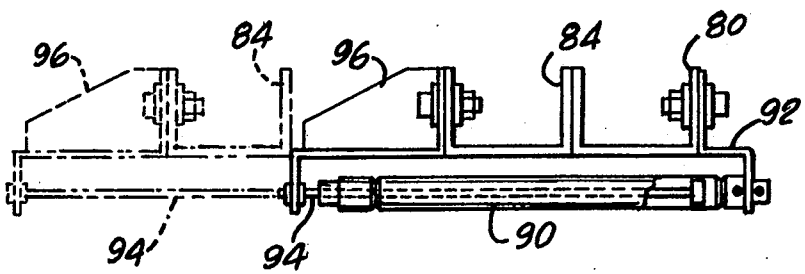
FIG. 7 is a sectional view taken substantially as indicated along the line 7—7 of FIG. 3.
Figure 6:
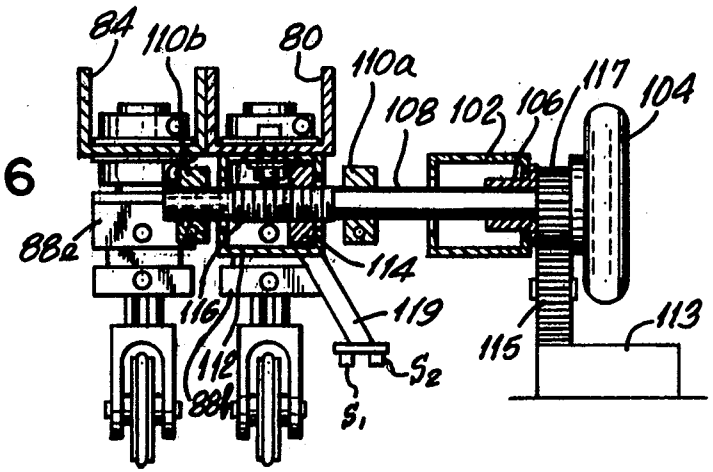
FIG. 6 is a sectional view taken substantially as indicated along the line 6—6 of FIG. 3.

As shown in FIGS. 1, 3, and 6, the alignment device 20 has an elongated bar 102 extending between the posts 74*a* and 74*d*, and the alignment device 20 has a hand wheel 104 rotatably mounted in the bar 102 by a bushing 106, with the hand wheel 104 having an elongated rod 108 having a pair of spaced collars 110*a* and 110*b* secured to the rod 108. The alignment device 20 has a bracket 112 secured to an underside of the channel 80, with the bracket 112 retaining a threaded indexing member 114 which receives a threaded portion 116 of the rod 108 intermediate the collars 110*a* and 110*b*. As the hand wheel 104 is rotated, the threaded portion 116 of the rod or shaft 108 co-operates with the indexing member 114 in order to move the channel 80 laterally along the rods 76 and 78, with the channel 80 being movable by the hand wheel 104 between a first inner position with the bracket 112 engaged against the collar 110*a* and a second outer position with the bracket 112 engaged against the collar 110*b*. The location of the first inner position and the second outer position may be modified through selection of the locations of the collars 110*a* and 110*b* on the shaft 108. Since the channel 84 is connected to the channel 80 through the cylinders 90, the channel 84 is also moved the desired distance between the first and second positions along with the channel 80 as the hand wheel 104 is rotated. In this manner, the alignment members 88*a*, 88*b*, 88*c*, 88*d*, 88*e*, and 88*f* are all moved as a single assembly laterally across the belt 54 a selected distance. In an alternative form, the hand wheel 104 may be automatically adjusted through use of a suitable device, such as a timing pulley, belt, and stepping motor to automatically adjust the trim widths. Thus, as graphically shown, the device 20 may have a stepper motor 113 which drives a suitable gear 115 which is meshed with a gear 117 mounted on the rod 108 in order to drive the gear 117 and rod 108 through the rotatable gear 115. The trim width may be set to a specific width which may be preprogrammed or determined by a suitable sensor mounted at the sewing machine, and the stepper motor causes automatic adjustment of the trim width to the selected amount. The device 20 may also have suitable sensors $S_1$ and $S_2$ mounted by an arm 119 extending from the bracket 112 at a location adjacent the associated alignment members 88 above the moving belt of the alignment device for a purpose which will be described below.

As shown, the alignment device 20 has a pair of helical compression springs 118 extending along the rods 76 and 78, respectively, between the bearings 82*a* and 82*b* and associated collars 120. The springs 118 pre-load the alignment assembly.

With reference to FIGS. 8–10, the alignment members 88*a*, 88*b*, 88*c*, 88*d*, 88*e*, and 88*f* comprise wheel assemblies 124 mounted on a support plate 122 of the channels 80 and 84. The alignment member or wheel assembly 124 has a rotatable wheel 126 defining a peripheral groove which receives an elastic 0-ring 130, with the wheel 126 being shown in the extended position. The wheel assembly 124 has a pivot trunnion 132 extending through an a suitable opening of the plate 122, with the wheel assembly 124 having a collar 136 which is clamped on the trunnion 132. The wheel assembly 124 also has a second collar 144 which is clamped on the trunnion 132 on a side of the plate 122 opposed the collar 136.The wheel assembly has an extend port 148 and a retract port 150 which control outer and inner movement of the piston in the assembly 124 in order to move the wheel 126 between a first vertical position engaged against the belt 54 and a second vertical position spaced above the belt 54. The assembly 124 has a bracket 152 secured in the assembly 124 by a pair of rods 154, with the wheel 126 being mounted on the bracket 152 by a rotatable shaft 156.

With reference to FIGS. 1–5, and 8–10, the angle of the wheel 126 relative to the belt 54 may be adjusted by selective securement of the collar 136 on the trunnion 132, and may be automatically accomplished, if desired, through use of a suitable device, such as a stepper motor. As the assembly 124 is actuated through the ports 148 and 150, the wheel 126 is moved between a first lower extended position engaged against the belt 54 and the underlying plate 70 which supports the belt 54 in this configuration, and a second upper retracted position spaced away from the belt 54. As the sleeves move along the belt 54 towards the sewing machine 24, the wheels 126 of the assemblies 124 engage against the sleeves intermediate the wheels 126 and the belt 54 when the wheels 126 are located in the extended position in order to displace the sleeves laterally across the belt 54 as they pass towards the sewing machine 24. The sleeves are moved laterally by the alignment members 88 or wheel assemblies 124 only while the associated wheels 126 are engaged against the sleeves and belt 54, and are released when the wheels 126 are moved away from the belt 54. The wheel associated with the alignment device 88*a* moves the sleeve laterally towards a side 164 of the belt 54 when the wheel of the alignment member 88*a* is engaged against the belt 54, and the wheel associated with the alignment member 88*b* moves the sleeves laterally away from the side 164 of the belt 54 towards an opposed side 166 of the belt 54 when the wheel associated with the alignment member 88*b* is engaged against the belt 54. The wheel associated with the alignment member 88*d* moves the sleeve laterally toward the side 164 of the belt 54 when the wheel associated with the alignment member 88*d* is engaged against the belt 54, and the wheel associated with the alignment member 88*c* moves the sleeve laterally away from the side 164 of the belt 54 toward the opposed side 166 of the belt 54 when the wheel is engaged against the belt 54. The wheel associated with the alignment member 88*f* moves the sleeve laterally toward the side 164 of the belt 54 when the wheel associated with the alignment member 88*f* is engaged against the belt 54, and the wheel associated with the alignment member 88*e* moves the sleeve laterally away from the side 164 of the belt 54 toward the opposed side 166 of the belt 54 when the wheel is engaged against the belt. In this manner, the alignment members 88*a* and 88*b* are utilized to achieve a coarse alignment of the sleeve, the wheels 88*c* and 88*d* are utilized to achieve a medium alignment of the sleeve subsequent to the coarse alignment, and the alignment members 88*e* and 88*f* are utilized to achieve a fine alignment of the sleeve subsequent to the medium alignment as the sleeves or workpieces pass in the alignment device 20 toward the sewing machine or station 24.

The alignment device 20 has a sensor 168 associated with the coarse alignment members 88*a* and 88*b* preferably mounted on the channel 80 and a second sensor 170 associated with the coarse alignment members 88*a* and 88*b* mounted on the channel 80, with the first sensor 168 being located to sense the sleeves at a first lateral location of the alignment device 20 on the belt 54, and the second sensor 170 being positioned to sense the sleeves at a second lateral location spaced from the first location in the alignment assembly 20 on the belt 54, with the first and second locations associated with the sensors 168 and 170 being laterally spaced from each other.

The sensor 168 is utilized to control actuation of the alignment member 88*a*, while the sensor 170 is utilized to control actuation of the alignment member 88*b*, which may be accomplished through use of a central processing unit (CPU) which is electrically connected to the sensors 168 and 170 and associated alignment members 88*a* and 88*b* in order to actuate the associated wheels. The alignment member 88*a* is repetitively actuated in order to move the sleeve toward the side 164 of the belt 54 until the sensor 168 senses presence of the sleeve at the first lateral location, and when the sensor 168 senses the sleeve at the first lateral location, the alignment member 88*a* is disengaged to prevent movement of the sleeve toward the side of the belt. In the event that the sensor 170 senses presence of the sleeve at the second lateral location at this time, the alignment member 88*b* is actuated in order to move the sleeve away from the side 164 of the belt. In this manner, the sleeve is repetitively moved back and forth between the first and second lateral locations associated with the sensors 168 and 170 in order to align the sleeve along a line in a lateral window with an edge between the sensors 168 and 170 during coarse alignment of the sleeve.

The alignment device 20 has a third sensor 172 associated with the alignment member 88*d* and mounted on the channel 80, and a fourth sensor 174 mounted on the channel 80 and associated with the alignment member 88*c*, such that the sensor 172 causes actuation of the alignment member 88*d*, and the sensor 174 causes actuation of the alignment member 88*c* which may be accomplished through the CPU. The third sensor 172 is positioned to sense the sleeves at a third lateral location of the alignment device 20 on the belt 54, and the fourth sensor 174 is positioned to sense the sleeves at a fourth lateral location spaced from the third location in the alignment assembly 20 on the belt 54, with the third and fourth locations associated with the sensors 172 and 174 being located downstream from the first and second locations. The alignment member 88*d* is repetitively actuated in order to cause movement of the sleeve toward the side 164 of the belt 54. In the event that the sensor 172 senses presence of the sleeve at the third lateral location, the sensor 172 causes disengagement of the alignment member 88*d* in order to prevent movement of the sleeve toward the side 164 of the belt. In the event that the sensor 174 determines that the sleeve is located at the fourth lateral location, the sensor 174 causes actuation of the alignment member 88*c* at this time in order to cause movement of the sleeve away from the side 164 of the belt 54. In this manner, the sensors 172 and 174 are utilized to repetitively move the sleeve back and forth to align the sleeve along a line in a window during medium alignment of the sleeve which is smaller than the window during coarse alignment of the sleeve in order to cause medium alignment of the sleeve for the sewing station 24, with an edge of the sleeve located between the sensors 172 and 174. Thus, the sleeve is aligned to a first window during coarse alignment of the sleeve by the sensors 168 and 170 associated with the alignment members 88*a* and 88*b*, respectively, and the sleeve is subsequently aligned to a second window which is smaller than the first window through use of the sensors 172 and 174 associated with the alignment members 88*d* and 88*c*, respectively.

The alignment device 20 has a fifth sensor 173 associated with the alignment member 88*f* and mounted on the channel 80, and a sixth sensor 175 mounted on the channel 80 and associated with the alignment member 88*e*, such that the sensor 173 causes actuation of the alignment member 88*f*, and the sensor 175 causes actuation of the alignment member 88*e* which may be accomplished through the CPU. The fifth sensor 173 is positioned to sense the sleeves at a fifth lateral location of the alignment device 20 on the belt 54, and the sixth sensor 175 is positioned to sense the sleeves at a sixth lateral location spaced from the fifth location in the alignment device 20 on the belt, with the fifth and sixth locations associated with the sensors 173 and 175 being located downstream from the third and fourth locations. The alignment member 88*f* is repetitively actuated in order to cause movement of the sleeve toward the side 164 of the belt 54. In the event that the sensor 173 senses presence of the sleeve at the fifth lateral location, the sensor 173 causes disengagement of the alignment member 88*f* in order to prevent movement of the sleeve toward the side 164 of the belt. In the event that the sensor 175 determines that the sleeve is located at the fifth lateral location, the sensor 175 causes actuation of the alignment member 88*e* at this time in order to cause movement of the sleeve away from the side 164 of the belt 54. In this manner, the sensors 173 and 175 are utilized to repetitively move the sleeve back and forth to align the sleeve along a line L in a window during fine alignment of the sleeve which is smaller than the window during medium alignment of the sleeve in order to cause fine alignment of the sleeve for the sewing station 24, with an edge of the sleeve located between the sensors 173 and 175. Thus, the sleeve is aligned to a first window during coarse alignment of the sleeve by the sensors 168 and 170 associated with the alignment members 88*a* and 88*b*, respectively, the sleeve is then aligned to a second window which is smaller than the first window through use of the sensors 172 and 174 associated with the alignment members 88*d* and 88*c*, respectively, and the sleeve is subsequently aligned to a third window which is smaller than the second window through use of the sensors 173 and 175 associated with the alignment members 88*f* and 88*e*, respectively. In this manner, the sleeve is progressively aligned to smaller windows as the sleeve passes to the sewing station 24.

The alignment assembly 180 comprising the channels 80 and 84, the sensors 168 and 170 associated with the alignment members 88*a* and 88*b*, the sensors 172 and 174 associated with the alignment members 88*d* and 88*c*, and the sensors 173 and 175 associated with the alignment members 88*f* and 88*e*, is moved as a unit through use of the hand wheel 104 in order to laterally displace the alignment line L relative to the sewing machine 24.

The spacing between the alignment members 88*a* and 88*b*, the alignment members 88*c* and 88*d*, and the alignment members 88*e* and 88*f* may be modified a selected amount through use of the cylinders 90. In this manner, the alignment member 88*b* may be moved laterally relative to the alignment member 88*a*, the alignment member 88*c* may be moved laterally relative to the alignment member 88*d*, and the alignment member 88*e* may be moved laterally relative to the alignment member 88*f* in order to accommodate and align sleeves of different size.

As shown, the angle $alpha_1$ of the wheel associated with the alignment member 88*a* relative to the moving direction of the belt 54 (L.O.F.) is opposite the angle $alpha_2$ of the wheel associated with the alignment member 88*b* relative to the moving direction of the belt 54, and these skew angles are preferably the same. The angle $beta_1$ of the wheel associated with the alignment member 88*d* is opposite the angle $beta_2$ of the wheel associated with the alignment member 88*c*, and these skew angles are preferably the same. The angle $gamma_1$ of the wheel associated with the alignment member 88*f* is opposite the angle $gamma_2$ of the wheel associated with the alignment member 88*e*, and these skew angles are preferably the same. The skew angle of the wheels associated with the alignment members 88*e* and 88*f* is not as great as the skew angle of the wheels associated with the alignment members 88*c* and 88*d*, and the skew angle of the wheels associated with the alignment members 88*c* and 88*d* is not as great as the skew angle associated with the alignment members 88*a* and 88*b*. The distance between the sensors 173 and 175 is less than the distance between the sensors 172 and 174 in order to increase the accuracy of alignment by the fine alignment members 88*e* and 88*f*, and the distance between the sensors 172 and 174 is less than the distance between the sensors 168 and 170 in order to increase the accuracy of alignment by the medium alignment members 88*c* and 88*d* relative to the coarse alignment members 88*a* and 88*b*.

The sewing head of the sewing machine 24 normally trims material from an edge of the sleeve. It is desirable to control the trim of the sleeves in order to produce a trim which is the same in the leading and trailing edges of the sleeve, such that the trim is symmetric. In the event that the sleeve is not trimmed properly, then the sleeve may be open when folded and sewn by the sewing machine 24. Through use of the hand wheel 104 in moving the alignment line L laterally relative to the sewing machine 24 in conjunction with the parameters of the alignment device 20, such as the skew angle, the hand wheel 104 may be utilized to shift the edge of the sleeve for either more or less trim in order to control the amount of waste material in the trim. The alignment device 20 results in a repeatable amount of trim in the sleeves irrespective of the orientation of the sleeves as they are placed on the belts 26. In this manner, the amount of trim from the sleeves generated by the sewing machine 24 may be accurately controlled through use of the hand wheel 104 to modify the lateral location of the alignment assembly. The alignment device thus aligns the sleeves to an alignment line L, and the alignment line L is moved laterally relative to the sewing machine in order to control the amount of trim.

With reference to FIG. 11a, prior devices tended to overload the sleeves S at B during alignment when placed in the illustrated skewed configuration. With reference to FIG. 11*b*, the prior devices tended to overload the sleeves S at A during alignment when placed in the illustrated configuration. With reference to FIG. 11*c*, the prior devices tended to align the sleeve S at A and B during alignment of the illustrated configuration of the sleeves which may produce an open hem. With reference to. FIG. 11*d*, the prior devices tended to align the sleeve S at A and C or C and B of the illustrated sleeve S which would cause a crooked and possibly open hem. With reference to 11*e*, the prior devices tended to overload the sleeve S at high spots along the illustrated irregular edge.

In accordance with the present alignment device, with reference to FIG. 11*a*, the device rotates A parallel to the alignment line in order to properly align the sleeve. With reference to FIG. 11*b*, the alignment members 88*b* and 88*c* prevent A from being overloaded during alignment of the sleeve S. With reference to FIG. 11c, the alignment device causes overload at A and B of the sleeve until C is aligned for passage to the sewing machine 24. With reference to FIG. 11*d*, the device overloads at C of the sleeve S until A and B are aligned for passage to the sewing machine. With reference to FIG. 11*e*, the alignment device 20 overloads the sleeve S at all the illustrated high points until low points are aligned for passage to the sewing machine 24.

FIG. 12 is a diagram showing characteristic curves exhibited by the wheel assemblies when the wheels of the assemblies correct the garments (inches) varying as given on the ordinate with an angle (degrees) varying as given on the abscissa. The fluid pressures of the wheel assemblies as given on the abscissa (PSI) are controlled to produce an optimum displacement. The fluid pressures are also controlled to reduce the sound levels as given on the ordinate (DBA) of the assemblies. The alignment device 20 acts on the sleeve in a different manner due to a progressively decreasing smaller window. A time constant is also provided as given on the abscissa for the ratio of the time the wheels of the assemblies are engaged against the garment or belt ($T_{up}$) in relationship to the time the wheels are away from the garment or belt($T_{down}$). The time constant designates the ratio of the time against the garment in milliseconds relative to the time in milliseconds away from the garment, with a ratio of 1:1 being shown at time $T_1$ in the drawings, $T_{up}/T_{down}$. The frequencies of the wheel assemblies in engaging the garments and belt may also be controlled.

Thus, the wheel assemblies are tuned to produce an optimum amount of correction or displacement while lowering fluid pressures at higher amounts of correction in order to produce optimum results. In addition, the wheel assemblies are tuned in order to reduce the sound levels, and minimum air pressures are utilized in order to maintain the noise levels at a reduced level. Further, steeper angles are obtained by the wheel assemblies, and the number of contacts by the wheel assemblies against the sleeves are reduced. The sewing head trims material from the sleeves as they pass through the sewing machine. The amount of material trimmed by the sewing machine is controlled in an accurate manner through tuning of the wheel assemblies to produce optimum displacements, and the adjustment of the trim by the hand wheel or optional automatic adjustment is provided in order to modify the alignment line in a precise and simplified manner. The trim is controlled to have the same amount of material in the leading and trailing edges of the trim, and the alignment device produces a repeatable amount of trim irrespective of the manner in which the sleeves are orientated on the alignment device during placement. Due to the improved control of alignment, additional material will be saved from the sleeves resulting in a more economic operation of the sleeves and prevention of waste of material by the sleeves.

The dynamic characteristics of the wheel assemblies may be controlled, and the parameters for each sleeve may be selected in a suitable microprocesser. The dynamic balancing of the wheel assemblies is achieved due to the mass ratio between parts of the assembly. The air pressure, skew angle, and the height or stroke length may be modified to control the energy levels of the wheels pressing on the belt or the force of the wheels on the belt. The duration of the wheels against the sleeve and belt may also be controlled to vary the energy levels of the wheel assemblies. The frequency of the wheel assemblies moving against the belt may be controlled, and the device produces an automatic spacing between sleeves and conceivably the space in which the sleeves are placed. The alignment device produces an optimum amount of correction while resulting in an increase of belt life of the machines and a more economic use of the machines. The device also provides an improvement to sewing and an improved production of sleeves resulting in a more economic use of the material. The device also produces a maximum number of contacts against the sleeves to achieve correction or the device may otherwise wrinkle the material. The device acts more efficiently on the garments in the alignment windows to displace the sleeves.

Figure 13:
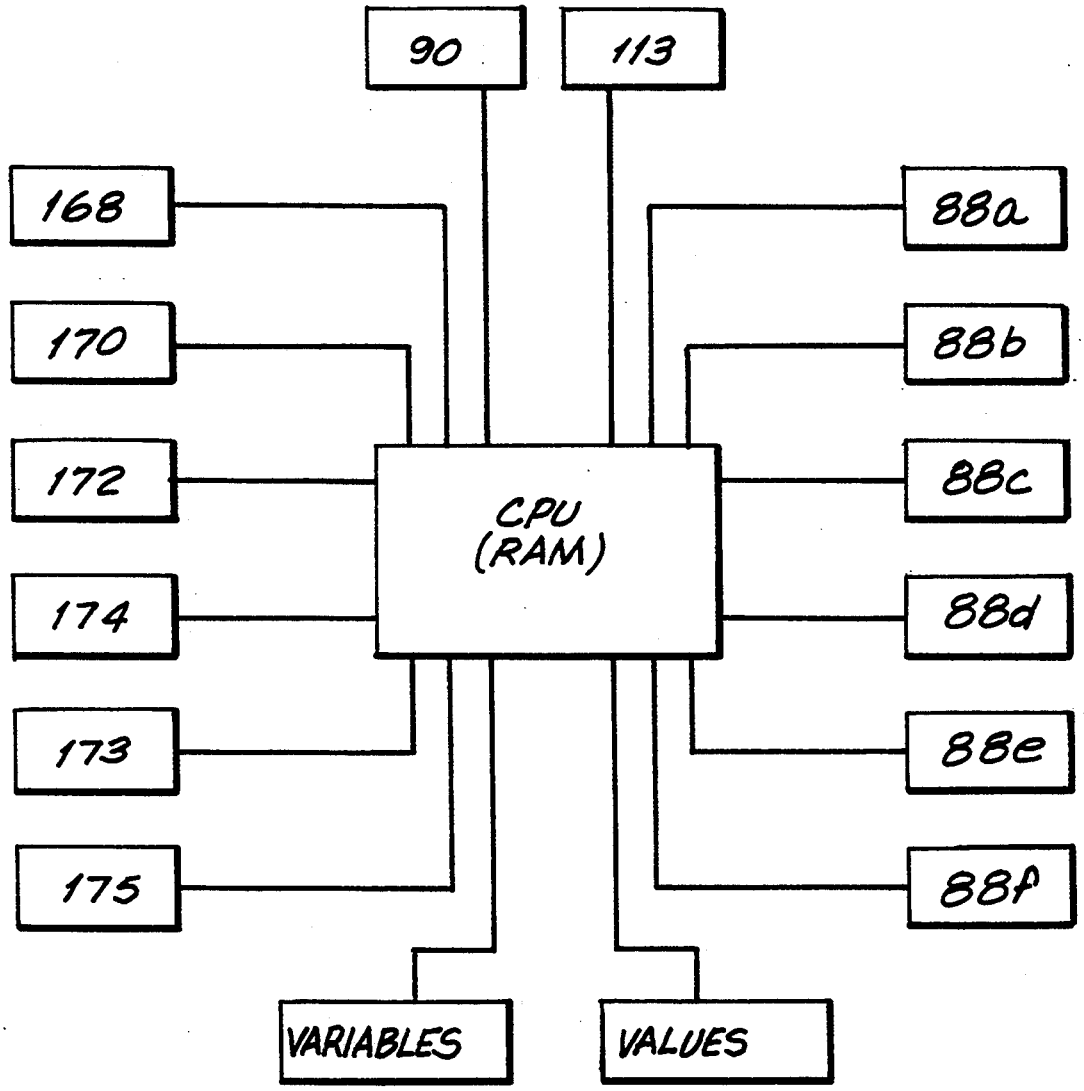
FIG. 13 is a schematic block diagram of a control system for the alignment device of the present invention.

FIG. 13 is a block diagram of the central processing unit CPU for the alignment device 20 of the present invention. The CPU may have a random access memory to permit the storage of data therein. In accordance with the present invention, variables may be associated with the skew angles, time constants, fluid pressures, frequencies, and width and trim, and may be controlled, such as by programming or modifying these variables. As is well known in the art, such programming or modifying of variables may be carried out by user controllable means. Such user controllable means are represented by the block circuit means "VARIABLES" in FIG. 13. Further, values may be associated with the garments, such as color, knit, weight, and may be utilized to control operation of the device. The values may be varied, and may be programmed and the routine may be modified, as desired.

The sleeves may be rapidly and simply placed in the space in order to simplify placement with increased speed, and the placed sleeves are moved towards the sewing machine where they are aligned during course alignment to a lateral window at least as large as the space in which they are placed to produce a coarse alignment of the sleeves, the sleeves are then aligned to a second lateral window which is smaller the first window during medium alignment to produce a medium alignment of the sleeves, and the sleeves are subsequently aligned to a third window which is smaller than the second window during fine alignment to produce a fine alignment of the sleeves for trimming and sewing. The alignment windows may be adjusted relative to the sewing machine. In this manner, improved placement and alignment of the sleeves in a rapid and precise manner is accomplished according to the invention.

The foregoing detailed description is given for clearness of understanding only, and no unnecessary limitations should be understood therefrom, as modifications will be obvious to those skilled in the art.

What is claimed is:

1. A device for aligning a workpiece for a sewing machine comprising, a plurality of wheel assemblies disposed along a line extending parallel to the moving direction of a movable surface and having a rotatable wheel engageable against the moving surface over the workpiece between the wheel and the surface, rotating means for modifying the angle of said wheel assemblies relative to the moving direction of the surface, fluid pressure means for subjecting the wheel assemblies to fluid under a controlled pressure, in which the wheel assemblies have a controlled time constant of a ratio of the time of the wheels against the surface to the time of the wheels away from the surface, and in which the wheels may have a frequency of engaging contact with the surface, and user-controllable means for controlling said angle, fluid pressure, time constant and frequency.

2. The device of claim 1 wherein said user-controllable means for modifying said angle, fluid pressure, time constant, and frequency may be controlled to produce optimum results.

3. A sewing machine including a device for aligning an entire, discrete garment part prior to a commencement of sewing operation comprising:

means for moving the garment part towards the sewing machine;

sensor elements spaced apart by a predetermined distance to define a window therebetween; and means for aligning the garment part prior to the sewing operation at a plurality of discrete, progressively smaller lateral windows defined by successive pairs of sensor elements along the moving means.

4. The sewing machine of claim 3, wherein the aligning device including means for positioning the garment part on the moving means in a lateral space adjacent to each of and at least as small as said plurality of windows.

5. A sewing machine including a device for aligning a garment comprising:

means for moving the garment toward the sewing machine; and means for aligning the garment to a plurality of lateral windows along the moving means, wherein the aligning means comprises, means for aligning to a lateral first window along the moving means, and separate means for aligning the garment to a lateral second window smaller than the first window along the moving means.

6. The sewing machine of claim 3, wherein the aligning device including means for modifying the relative sensor placement to thereby modify the width of the plurality of windows.

7. The sewing machine of claim 3, wherein the aligning device including means for modifying the lateral location of said plurality of windows relative to the sewing machine.

8. A sewing machine including a device for aligning an entire, discrete garment part for the sewing machine, comprising:

means for continuously moving the garment part toward the sewing machine;

means for sensing the garment part at a first lateral location having a width, said location extending over an area situated prior to the sewing machine along the continuously moving means;

means for sensing the garment part at a second lateral location having a width smaller than the width of said first lateral location, said second location extending over an area situated prior to the sewing machine along the continuously moving means; and means for aligning the entire garment while moving toward the sewing machine along a line intermediate the first and second lateral locations.

9. The sewing machine of claim 8, wherein the aligning device including means for moving the sensing means associated with the first and second locations laterally relative to the sewing machine.

10. The sewing machine of claim 8, wherein the aligning device including means for modifying the position of the aligning means.

11. A sewing machine including a device for aligning an entire, discrete workpiece for the sewing machine, comprising:

means for dynamically aligning the workpiece prior to commencement of a sewing operation performed by said sewing machine along a line relative to the sewing machine;

means for trimming the workpiece; and means for adjusting the lateral location of the aligning means relative to the sewing machine to modify the amount of trim.

* * * * *